US005826389A

United States Patent [19]

Siler

[11] Patent Number: 5,826,389

[45] Date of Patent: Oct. 27, 1998

[54] BUILDING MANUFACTURE AND METHOD USING SYNTHETIC POLYMER STRUCTURAL ELEMENTS AND ADHESIVE BONDING

[76] Inventor: Steven Lynn Siler, 150 Kincaid Rd., Cumberland Gap, Tenn. 37724

[21] Appl. No.: 795,423

[22] Filed: Jan. 4, 1997

Related U.S. Application Data

[63] Continuation-in-part of Ser. No. 599,408, Nov. 29, 1995, abandoned.

[51] Int. Cl.[6] ..... E04C 1/00

[52] U.S. Cl. ..... 52/309.1; 52/656.9; 52/262

[58] Field of Search ..... 52/309.1, 262, 52/724.4, 724.5, 726.2, 726.3, 730.4, 731.5, 736.1, 736.2, 737.1, 93.1, 93.2, 712, 714, 656.9; 47/17; 156/71; 403/270, 265, 266

[56] References Cited

U.S. PATENT DOCUMENTS 4,068,423 1/1978 Marsh ..... 52/86

4,283,900 8/1981 Schubert ..... 52/712

FOREIGN PATENT DOCUMENTS 539189 9/1941 United Kingdom .

2026124 7/1979 United Kingdom ..... 52/712

*Primary Examiner*—Creighton Smith

*Attorney, Agent, or Firm*—Luedeka, Neely & Graham, P.C.

[57] ABSTRACT

A structure or housing manufacture and method for fabricating and constructing same comprising a small, light-weight static or movable building, storage or utility structure the structural elements of which include synthetic polymer composition, for example such as polyvinyl chloride (PVC), wherein joining of the structural elements is accomplished substantially by use of polymer adhesive bonding of said structural elements using L-shaped, right-angled plastic clips as joint-forming and strengthening elements.

16 Claims, 10 Drawing Sheets

BUILDING MANUFACTURE AND METHOD USING SYNTHETIC POLYMER STRUCTURAL ELEMENTS AND ADHESIVE BONDING

CROSS REFERENCE TO RELATED APPLICATION

This application is a Continuation-In-Part of patent application having U.S. Ser. No. 08/599,408, filed Nov. 29, 1995, now abandoned, titled POLYVINYL POST-N-LINTEL BUILDINGS.

BACKGROUND OF THE INVENTION

1. Field of the Invention

The present invention relates to a method for assembling and constructing relatively small, static utility or storage-shed type housing or enclosure structures using structural elements such as beams, headers, posts, connective elements, siding, roofing panels, trim and other elements made of synthetic polymer-containing compositions, and to structures made therefrom. The majority of the structural elements are connected and joined using polymer adhesives. A class of suitable synthetic polymer compositions used for the structural elements are compositions made from polyvinyl chloride, or PVC. The construction method employed uses post and lintel or post and beam design.

2. Description of the Prior Art

Synthetic, man-made or non-naturally occurring materials have been used in constructing static housing and buildings in the past, and it appears to be difficult to draw a clear line of distinction between synthetic materials and those that appear in nature, since the ordinary brick, made from naturally occurring clays, after being formed and heated or fired, may be considered to be synthetic. Nonetheless, over the years, as many of we humans have increased our knowledge and skills regarding the structure of matter, we have been able to create and invent synthetic materials that clearly have not been produced by non-human systems, events, interventions and actions. One class of such synthetic materials is that of the organic synthetic resins or organic synthetic high polymers. The term "plastic" is used to describe compositions comprising synthetic polymers or resins mixed with other materials, chemicals or additives. Since the term "plastic" originally was intended to identify a physical property of matter and not actual material structure or composition, the term does not well identify material or composition character in the strictest sense. However, as used in the context of the present invention, "plastic" is intended to define compositions or mixtures of solid high synthetic thermoplastic or thermoset polymers and copolymers with inorganic and organic filler additives and chemicals.

Materials made of synthetic resin or high polymer compositions have been used in the past to form elements and components of buildings. For example, U.S. Pat. No. 5,253,458 to Christian discloses a simulated log home structure using hollow "plastic" tubes, each having an external simulated wood grain surface and having a horizontally extending groove molded axially thereon. The members are joined using mechanical fasteners, and are not joined by using adhesive bonding as in the present invention.

Moreover, U.S. Pat. No. 5,293,725 to Matticks et al, discloses a building structure having no fasteners, which is composed of three major components, to wit, a floor, sidewalls and a roof. The materials are preferred to be composed of what is described as "plastic", and preferably "recycled plastic". The structural components are joined by use of mechanical interlocking means, not by use of adhesive bonding. Further, the construction method employed is not a post and beam method, as it is in the present invention.

Further, U.S. Pat. No. 5,253,461 to Janoski et al. does describe a mechanical fastener-free roofing system for a building wherein a roof deck or substrate, preferably made of steel, is covered with an insulation layer, the insulation layer being adhered to the deck using curable synthetic polymer compositions and asphalt. No mention is made in the patent regarding the use of synthetic polymer composition structural supporting members adhesively bonded to other structural members of similar composition and material.

U.K. Pat. No. 539,189 to Bunton et al., published Sep. 1, 1941, discloses a building structure wherein synthetic resinous materials and laminates thereof may be used for various components of the building, namely for framework, flooring, ceiling and roofing. However, steel H-sections are used for vertical supporting members, or framework. The synthetic resin used is a phenolformaldehyde type, an early type of synthetic resin composition, developed by Baekland in 1911, known also as Baekalite. The vinyl type of synthetic polymers or resins were not yet available at the time of the Bunton et al. invention. Moreover, there is no disclosure of using polymer adhesives to join various members and elements.

U.S. Pat. No. 5,247,773 to Weir shows structural components and structures made therefrom having interlocking male and female locking means. The structural components may be made from extruded plastic. However, no details are provided regarding specific plastic compositions, nor is there any teaching of joining the structural elements using adhesive bonding.

None of the above inventions and patents, taken either singly or in combination, is regarded to describe or to suggest the instant invention as claimed.

SUMMARY OF THE INVENTION

The present invention is directed to a method of constructing relatively small, static building structures for enclosing a three dimensional space using post and lintel construction design, also called post and beam construction design, a fundamental building design. The basic method involves using a plurality of vertical posts to support a plurality of horizontal beams, the beams being joined to the posts at the top of the posts. The buildings herein contemplated are those used to store utility items for garden, household, agricultural, farm, industrial, business and shop utilities, and are contemplated therefore to have floor areas of from about 100 square feet to about 500 square feet. However, structures having other utilities are contemplated as hereinafter disclosed.

In contrast to prior art post and beam construction, in the present invention, the posts, the beams, the connector elements, clips, panels, and other structural components are made of synthetic high polymer or copolymer compositions or plastic compositions, and such components alone are used to manufacture static housing structures. Moreover, all of the component structures are fastened together using polymer adhesives, except for base plate members that require mechanical fasteners into concrete foundations.

In particular, rectangular-cross-sectional vertical post members are attached to rectangular, cross-sectional horizontal beams and to rectangular base plate members or sills using right angle clips or L-shaped connector or fastening elements. The angle-clips function to secure and to strengthen the joints between attached elements. The L-shaped angle-clips are attached to the two members to be joined by the use of polymer adhesives especially selected or formulated to possess high adhesive strength with respect to the type of polymer composition used to form the structural elements. In general, the selection of plastic adhesives most suitable and economical for use in bonding plastic compositions to other plastic compositions or to other materials may be made by one of ordinary skill in the art by reference to handbooks and other reference sources. For example, one such publication is entitled Handbook of Adhesives, Third Edition, I. Skeist, Chapman & Hall, 1990, Chapter 34, dealing with the bonding of plastics.

Although rectangularly shaped structural elements offer the simplest methods for making the buildings of the present invention, cylindrical structural elements may also be used for vertical support members. Clips or fastener elements should, of course, be designed, in that case, to conform to cylindrical configurations.

Because of its widespread availability, low cost, and because most of the components used in the manufacture of the buildings of the present invention are currently commercially available and are composed of a material commonly called PVC or polyvinyl chloride, compositions made from this material and polymer adhesives especially formulated to adhesively bond PVC components to other PVC components are preferred. However, high polymer compositions other than PVC and adhesives other than those especially designed for PVC may be used since the present invention is not regarded to be limited to structural elements made from any one specific polymer composition or any one specific adhesive composition. For example, polypropylene, polyethylene, polystyrene, polytetrafluoroethylene, polyacrylate or polyurethane thermoplastic polymer compositions may be used, and thermoset polymers such as epoxy, melamine and phenolic may be used, including expanded or foamed polymer products. Further, structural members comprising a combination of PVC members or elements with one or more structural elements made from the above mentioned polymer compositions, or other polymer compositions may be used. The term PVC as used herein means polyvinyl chloride polymers and copolymers of vinyl chloride with other co-polymerizable vinyl monomers.

The L-shaped angle-clips of the present invention, also preferably made of PVC, while they may be considered to be fastening devices, are not mechanical fastening devices in the ordinary sense. Thus, for the purposes of the present invention, the expression "mechanical fastening device" is intended to define a device using threaded frictional designs, for example, such as a bolt, screw or, more generally, is intended to define devices wherein a securing force is applied against the outside surfaces, or from within the interior of the structural element, or in other words, the non-contacting surfaces of the elements to be fastened. In the present invention, the predominant forces holding most of the structural members together are forces applied at the contact areas of the elements joined together, as an adhesive agent inherently functions.

Accordingly, it is a principal object of the present invention to provide a method of constructing relatively small static structures, such as utility storage sheds, animal shelters and tool sheds using substantially all synthetic high polymer compositions as the structural components, wherein elements are connected together without substantial use of mechanical fastening devices.

It is another object of the invention to provide a method for producing a lightweight static building structure which mimics existing pre-fabricated wooden or composite structures, but is capable of being manufactured in a time that is substantially less than that required to manufacture a pre-fabricated or conventional building of similar size.

It is a further object of the invention to provide a method for constructing a static building which does not require protective exterior coatings for its maintenance.

Still another object of the invention is to provide a method for constructing a static building predominantly made of synthetic polymer compositions, yet allowing for all customary accouterments thereof, such as door framing, doors, windows and window framing, gutters, downspout, electrical conduit tubing and roof hat sections.

It is an object of the invention to provide improved elements and arrangements thereof in a manufacture for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a static building structure and method of making same using structural elements made from predominantly synthetic high polymer compositions and adhesives adapted to have high adherence with respect to the polymer compositions selected.

Figure 1:
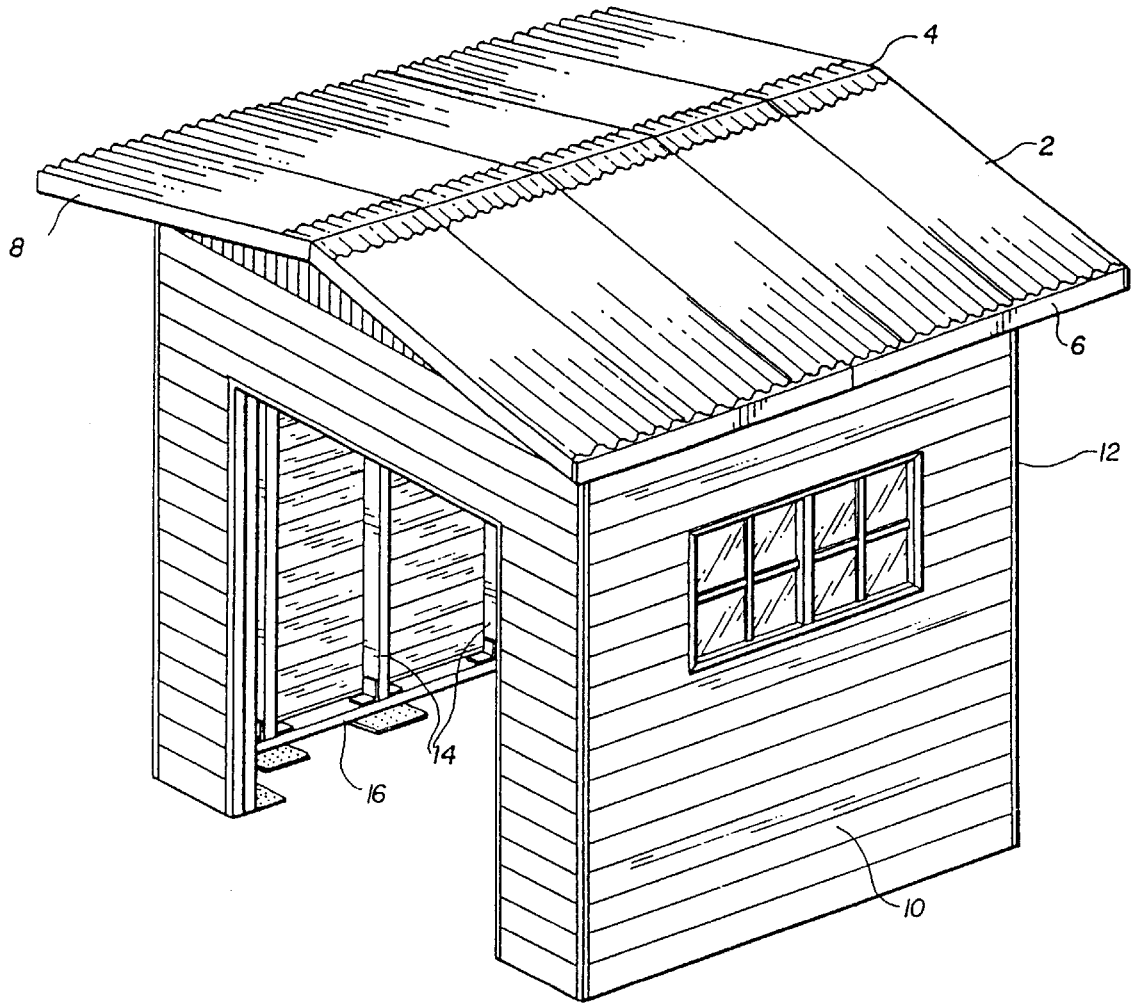
FIG. 1 is a perspective view of a substantially assembled structure.

Thus, FIG. 1 shows a substantially completed building made by the process of the present invention. Corrugated or flat roofing panels 2 are made of synthetic high polymer composition, particularly PVC, for example. Such panels are commercially available from building materials suppliers in the United States. Roofing panels 2 should be topped or capped at the ridge of the roof to prevent water from running through to the space below. Roofing caps 4 are also commercially available, or they may be easily made from cut sections of roofing panels 2 by heating and bending to form an appropriate angle of the roof. Below the roof panels, fascia boards 6 and 8, fabricated from polymer compositions such as PVC, are attached with polymer adhesives as hereinafter described. Wall panels or siding boards 10 are attached by adhesive bonding to the studs 14, trimmed at the comers with polymer composition trim 12. All components except for the base plate 16 are attached using adhesive bonding.

Figure 2:
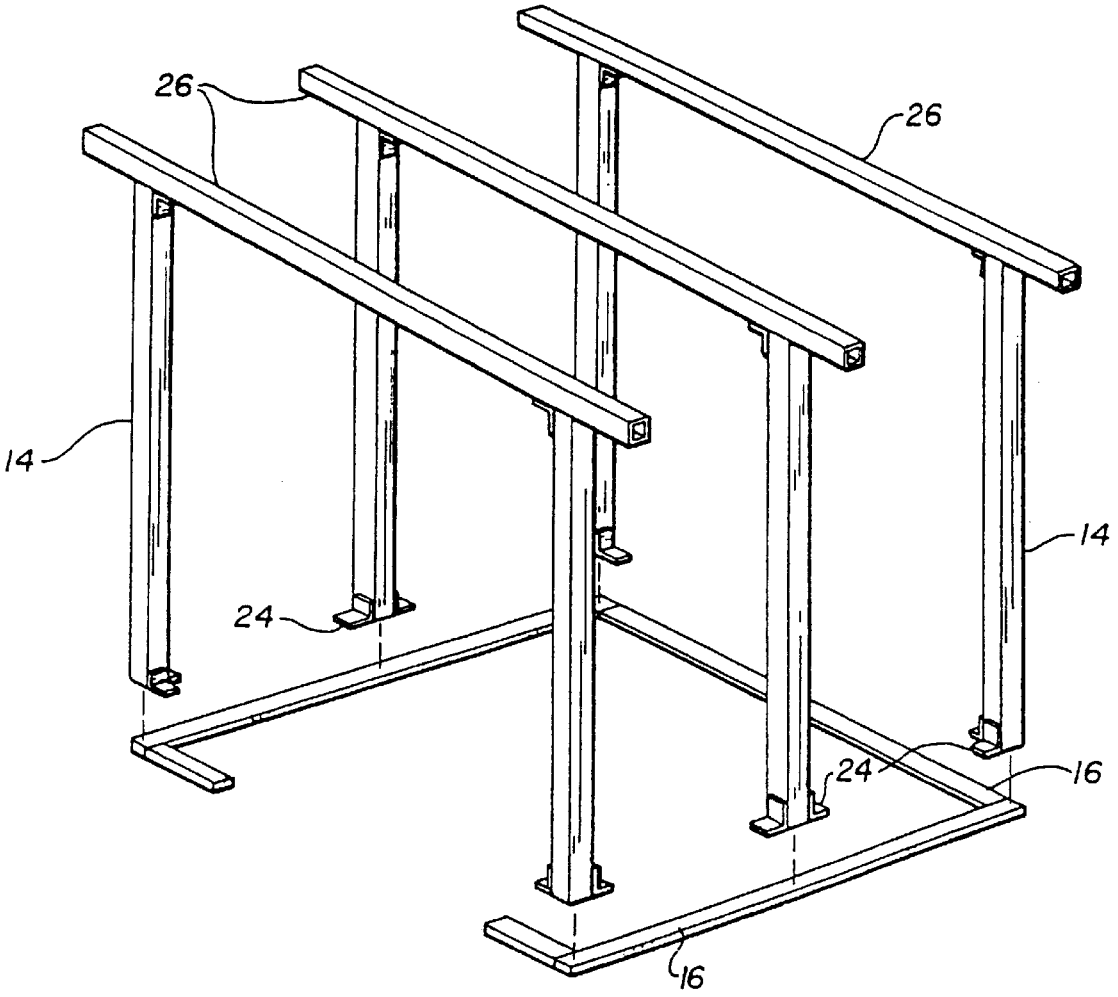
FIG. 2 is a perspective and exploded view of pole and beam attachment and wall posts joining to the baseplate.
Figure 3:
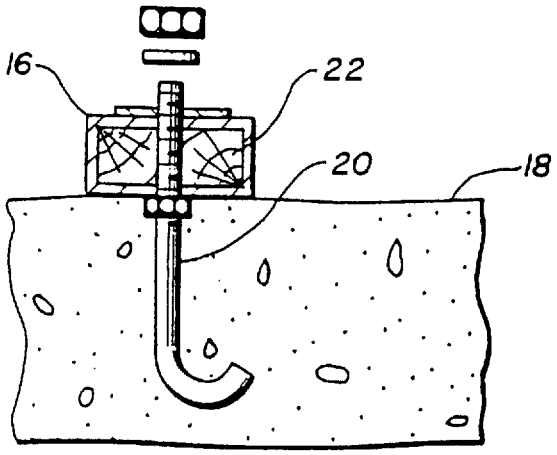
FIG. 3 is a sectional view of base plate attachment to a foundation of concrete.

Referring to FIG. 2, the construction process of a static building itself begins with attaching base plates 16 to a concrete surface or foundation 18, shown in FIG. 3. The base plates are composite structures, comprised preferably of a chemically, pressure treated wood core 22, resistant to vermin encroachments and decomposition, having a sheath or covering 16 of polymer composition completely surrounding the core, except at the ends. The composite base plate boards are commercially available. An example of one such commercial source is Erwin/US Fence Products, Inc. of Peachtree City, Ga. Another source for many of the structural elements of the present invention is The Tensar Corporation of Morrow, Ga.

As shown in FIG. 3, the base plates 16 are fastened to a concrete foundation 18 using metal bolts 20 and appropriate washers, bushings and threaded nuts.

Figure 4:
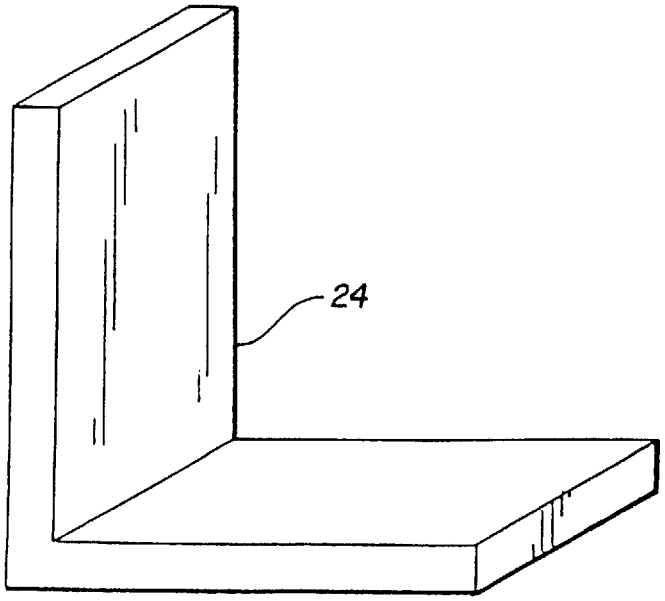
FIG. 4 is a perspective view of a plastic L-clip or angle-clip used to enhance joint strength between elements to be joined.

Continuing, FIG. 2 shows the position of vertical studs 14 fastened to the base plate 16 using adhesive bonding and right angled, L-shaped fastening devices or angle-clips 24, shown in FIG. 4. Clips 24 are made from polymer composition such as PVC, or the same or similar composition as the other structural components. Clips 24 are coated on one side with adhesive and attached to the inside top and bottom end portions of wall posts or studs 14. A compressive force may be used against the clips using a portable and adjustable clamp for a suitable time to bring the surfaces to be joined into closer physical contact and to enable the adhesive to more closely contact the interstices of the joined surfaces and thus to more effectively bond the clips to the studs. Usually about thirty seconds is sufficient for PVC adhesive compositions and structural elements.

In constructing a complete building, the L-shaped clips 24 are, via the use of polymer adhesives, adhered to the top and bottom inside wall posts or stud ends intended to be attached to the base 16 and to the beams 26. Alternatively, it is conceived that a construction assembly of structural elements may provided in the form of a kit. In this embodiment, the wall posts or studs may be provided to the user with clips pre-attached to inside top and bottom ends thus enabling a reduction of on-site labor cost and time. Further, base plates 16 may be provided with holes to allow for attachment to bolts 20, in which case bolts must be accurately placed and aligned to agree with the location of foundation 18 in the ground.

After all angle-clips have been attached to the bases of the studs or posts 14, then the beams or lintels 26 are joined to the wall posts by adhesive applied to the inside surface of the angle-clips and to the area of contact on the beam's lower surface. This task may be accomplished while the posts and beams are in a horizontal position. Clamps may be used to apply pressure to the angle-clips in contact with the beams. Beams 26 have an extension beyond the posts to create an overhang for the roof.

In using polymer adhesives for attaching various components of the present invention with angle-clips, the adhesive should be applied to or coated onto both contacting surfaces to be joined. Construction methods used in the present invention include corner squaring, leveling and the truing of vertical wall posts.

Figure 5:
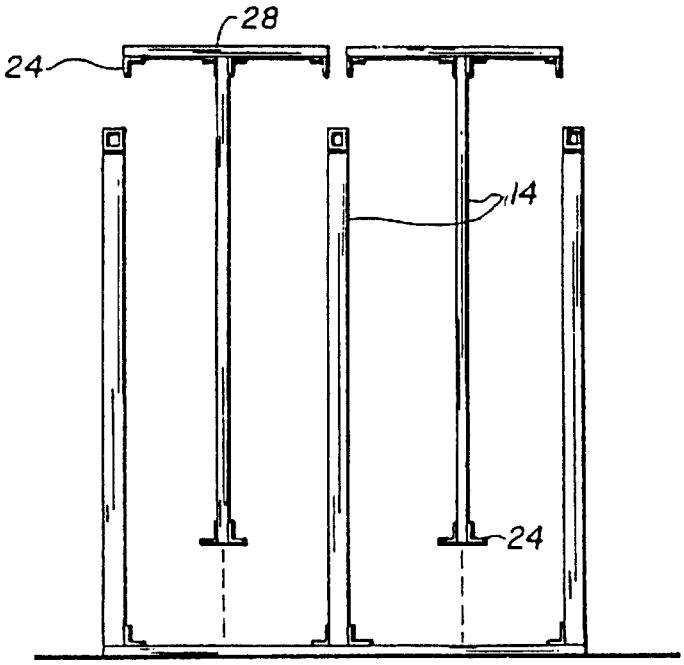
FIG. 5 is an elevational and exploded view of a sidewall framing, showing individual T-sections.

With respect to the side-wall framing construction, reference to FIG. 5 shows top plates 28 attached to wall posts 14 with angle-clips 24.

Following the joining of the wall posts and beams, single-T side wall frames are made by joining top plates 28 to wall posts 14 with angle-clips 24, and attaching additional angle-clips at the end portions of the top plates, as shown, and at the base of the wall posts as shown in FIG. 5. With respect to these single-T side-wall framing members shown in FIG. 5, they also may be provided in preassembled form with angle-clips or equivalent elements attached to enable the user to save construction time and costs. The assembled single-T side wall sections are then placed in the bay areas between wall posts 14 as shown in FIG. 5 and secured into place. Pressure applied downward and laterally from both top sides inwardly will help ensure stronger adhesion of the joints.

Figure 6:
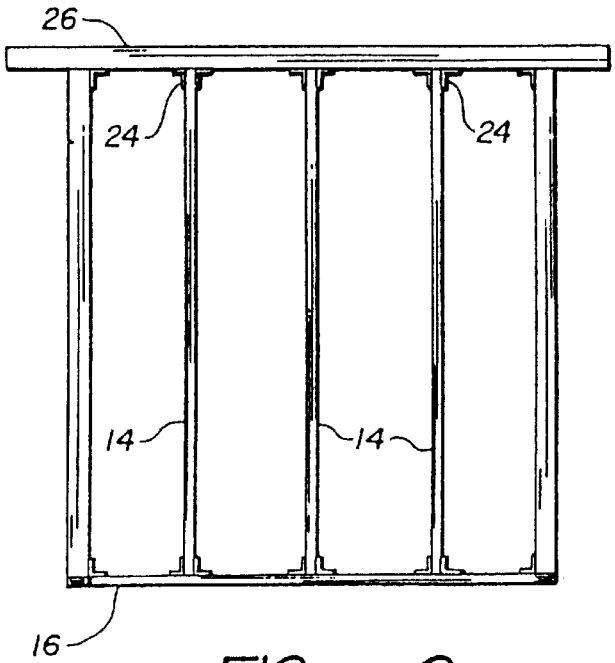
FIG. 6 illustrates the framing of the rear or back portion of a building.

With respect to the rear wall of the building, shown in FIG. 2 as being opposite to the wall having separated base plates, vertical wall post framing members 14 may be prefabricated in the form of "I" frames with angle-clips 24 attached to top and bottom ends as shown in FIG. 6. The "I" wall posts 14 are set and secured into position between beam 26 and base plate 16.

Figure 7:
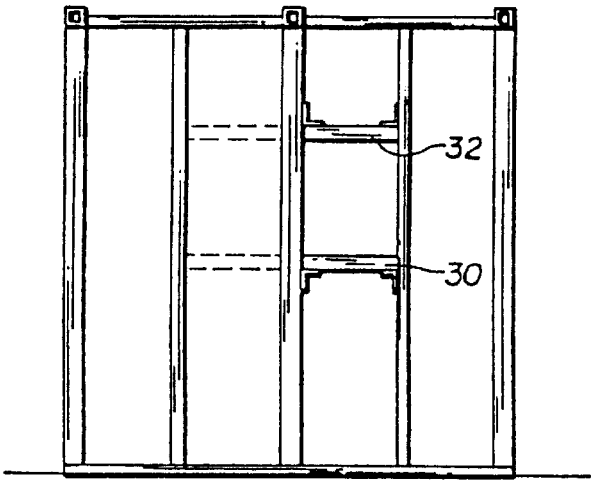
FIG. 7 illustrates an optional window sill and header placement.

Referring to FIG. 7, an arrangement is shown for providing for window installation, if a window is desired, showing the positioning of window sill 30 and window header 32, elements which should be placed into position before assembly of the roof is undertaken.

Figure 8:
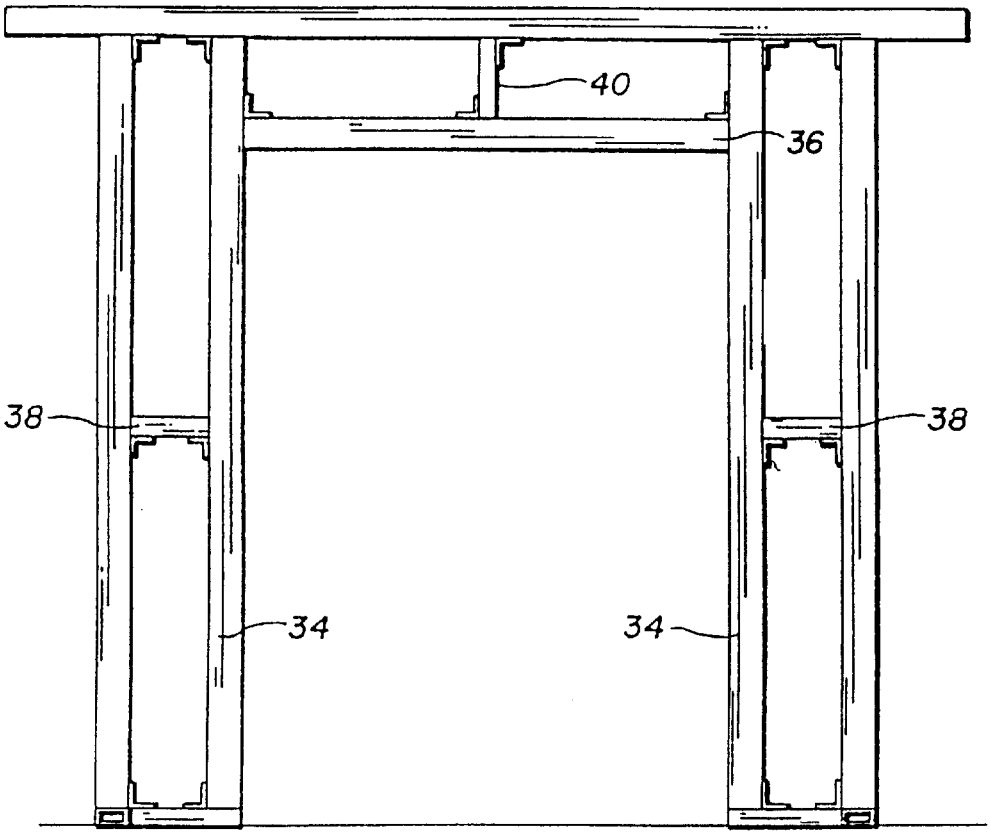
FIG. 8 is an elevational view of front door structural assemblies.

With respect to a method for providing for a door, FIG. 8 illustrates the PVC framing members and their respective positions, namely door header beam 36 and two door jams 34, door jam braces 38, and door frame cripple stud 40. The header beam, door jams, and other framed openings are preferably made of pressure and chemically treated wood core PVC composite boards, the same material as is preferably used for the base plates or sills.

FIGS. 9–12 illustrate a method for assembling the roof structure. The roof height at the midline of the roof is established by three plastic elements, preferably made of PVC, as herein previously stated, shown in FIGS. 9A and 9B as roof pitch channel 42, roof pitch beam 44 and roof pitch cube 46. This method is an accoutrement that can be modified with different size and type of elements to accomodate for the desired roof pitch.

Figure 9A:
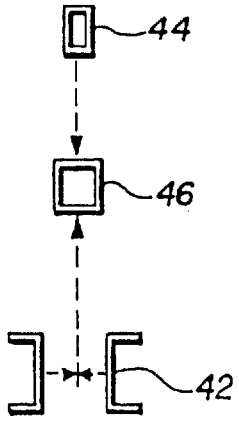
FIG. 9A is an exploded view of roof pitch elements and FIG. 9B shows the roof pitch elements in attached, working arrangement.
Figure 9B:
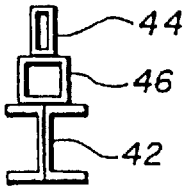
Figure 10A:
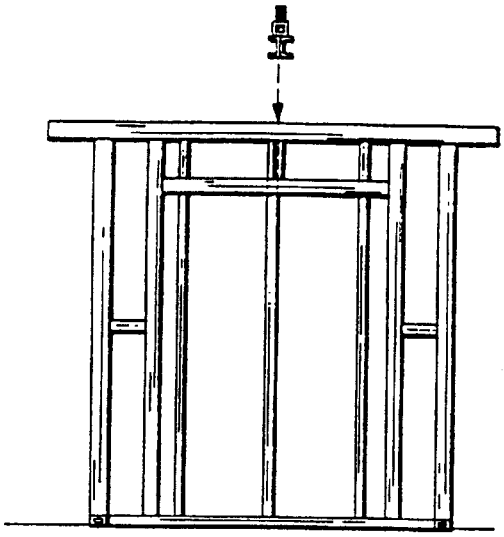
FIG. 10A, 10B, 10C and 10D are elevational-exploded views of roof construction.
Figure 10B:
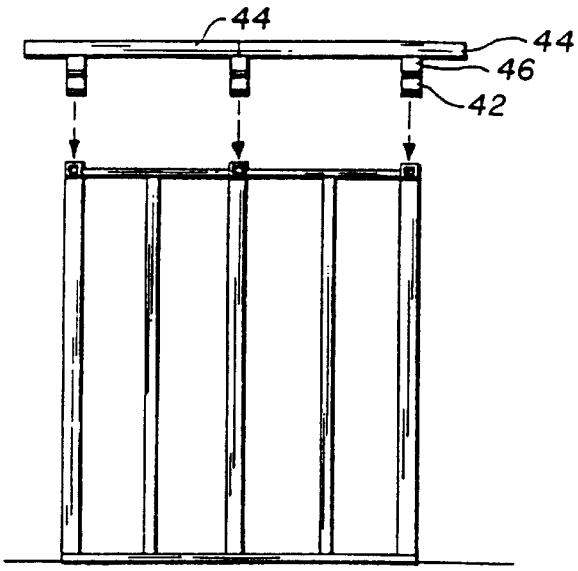

Referring to FIG. 9*a* element 42 is ordinarily a plastic element having dimensions of about 3"×4"×6" long, termed a roof pitch channel, made by "back to back" and using polymer adhesive to hold together two pieces of plastic elements having the structure 42 shown in FIG. 9*a* to arrive at the joined structure 42 shown in FIG. 9B. Roof pitch cube 46, is preferrably a cube of plastic material having side and length dimensions of 4". Element 44 is a plastic roof pitch beam preferrably having dimensions of 2"×4"×60" in length. Note FIGS. 10 and 11. Two such beams, joined end to end, are used to form the center support for roofing panels for a building having a front to rear roof dimension of 10 feet. However, the selection of suitable dimensions for the construction elements of the present invention is considered to be within the scope of one having ordinary skill in the building arts and depend upon the size of the building designed. The three components 42, 46 and 44 comprise a roof hat-section, made by adhering all pieces together in the manner shown in FIG. 9B. The hat-section may be assembled on a horizontal surface prior to placement upon the center portions of the beams as shown in FIGS. 10A and 11, or the hat-sections may be provided in pre-assembled form ready to mount in the case where the components are intended to be supplied as a kit. Obviously, if the hat-section were supplied as a kit, then there would be no need to form the roof pitch beams 44 from two separate lengths of rectangular PVC material. Only one contiguous length of such PVC material would be required.

Figure 10C:
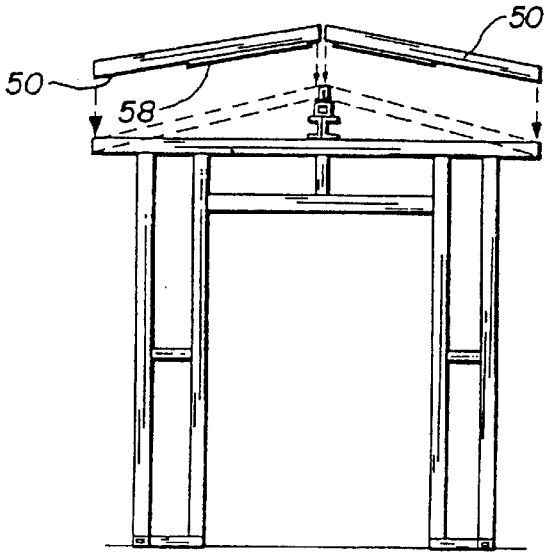
Figure 10D:
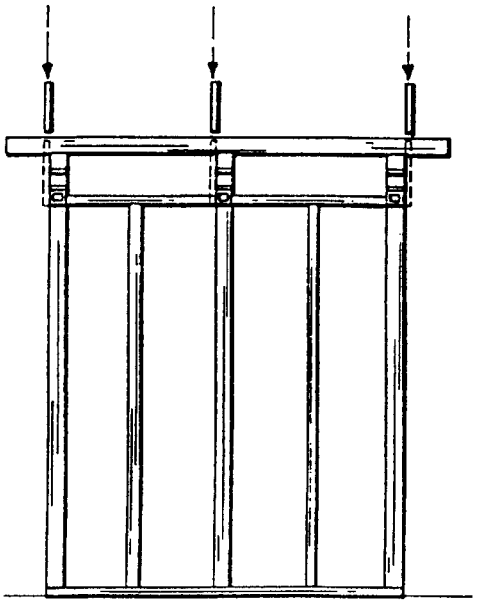
Figure 11:
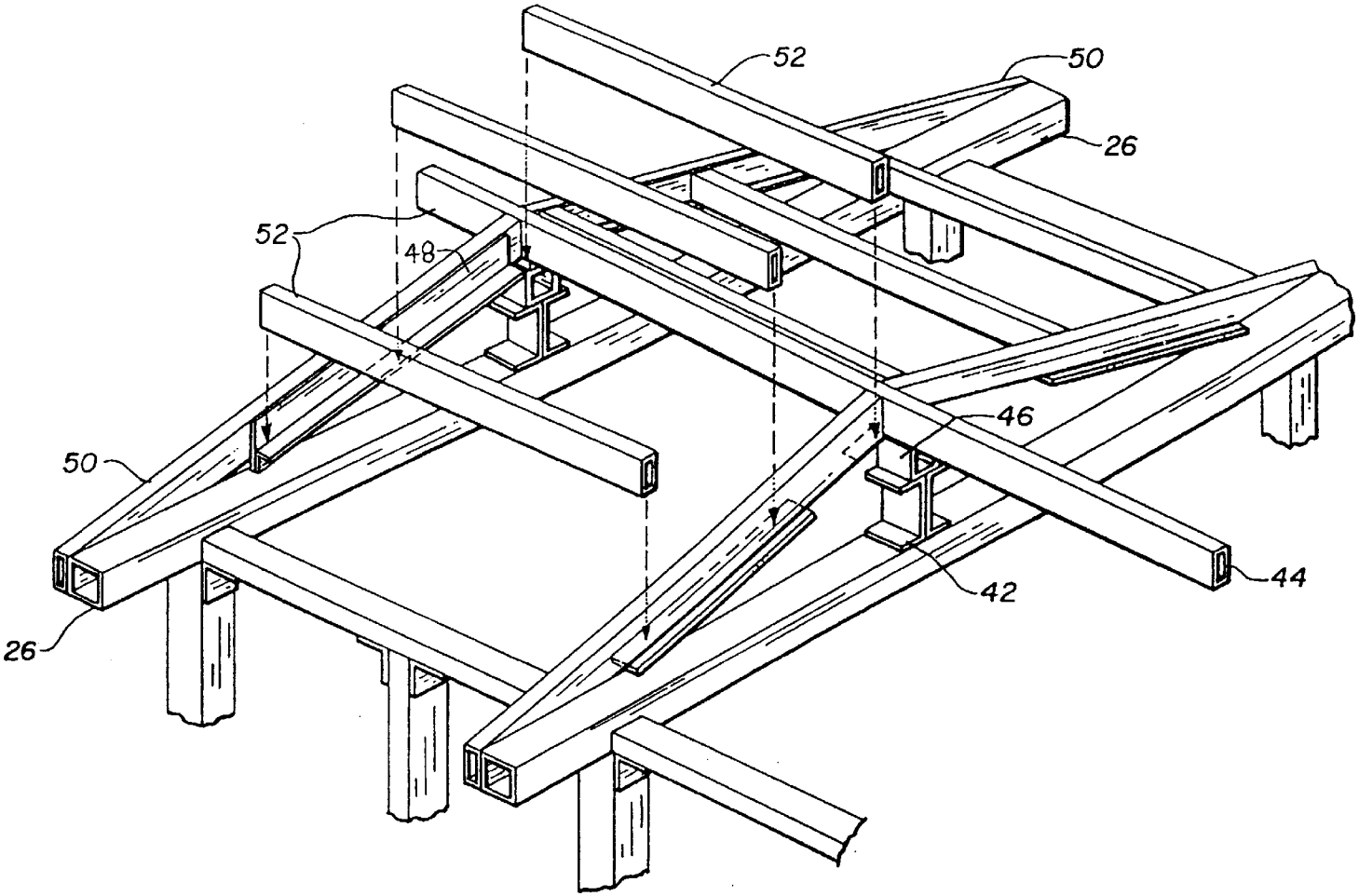
FIG. 11 is a perspective and exploded view of the roof construction.
Figure 12:
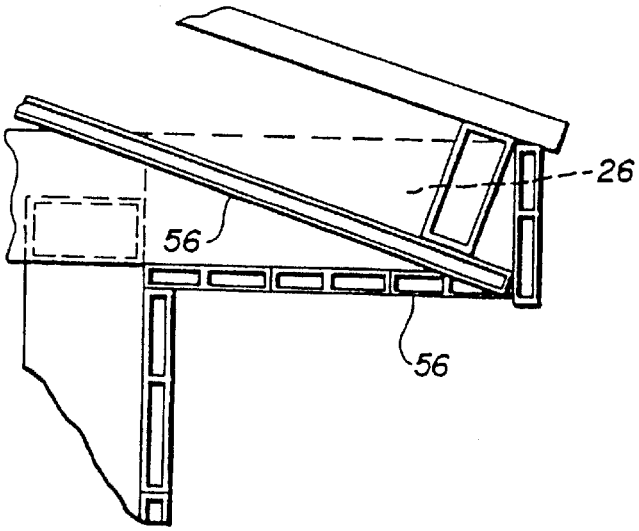
FIG. 12 is a sectional view of roof overhang and soffit placement.
Figure 13:
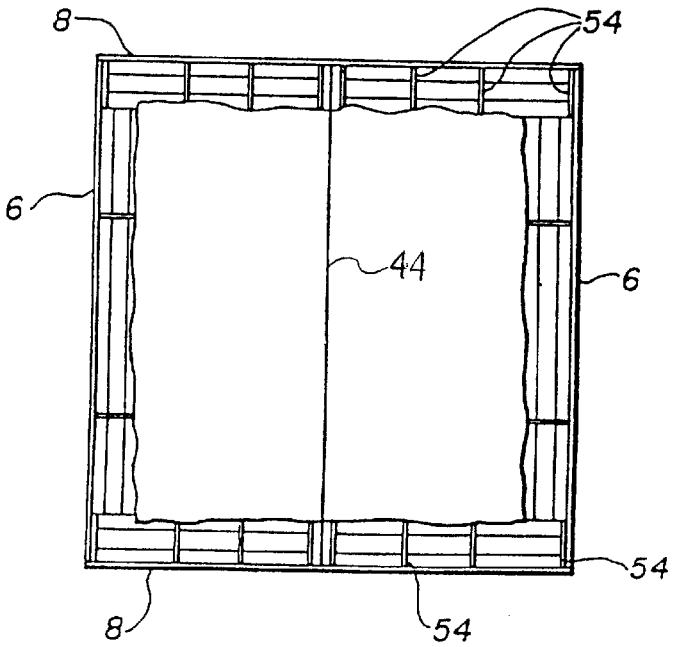
FIG. 13 is a top view and sectional view showing placement of overhang rafter inserts.
Figure 14:
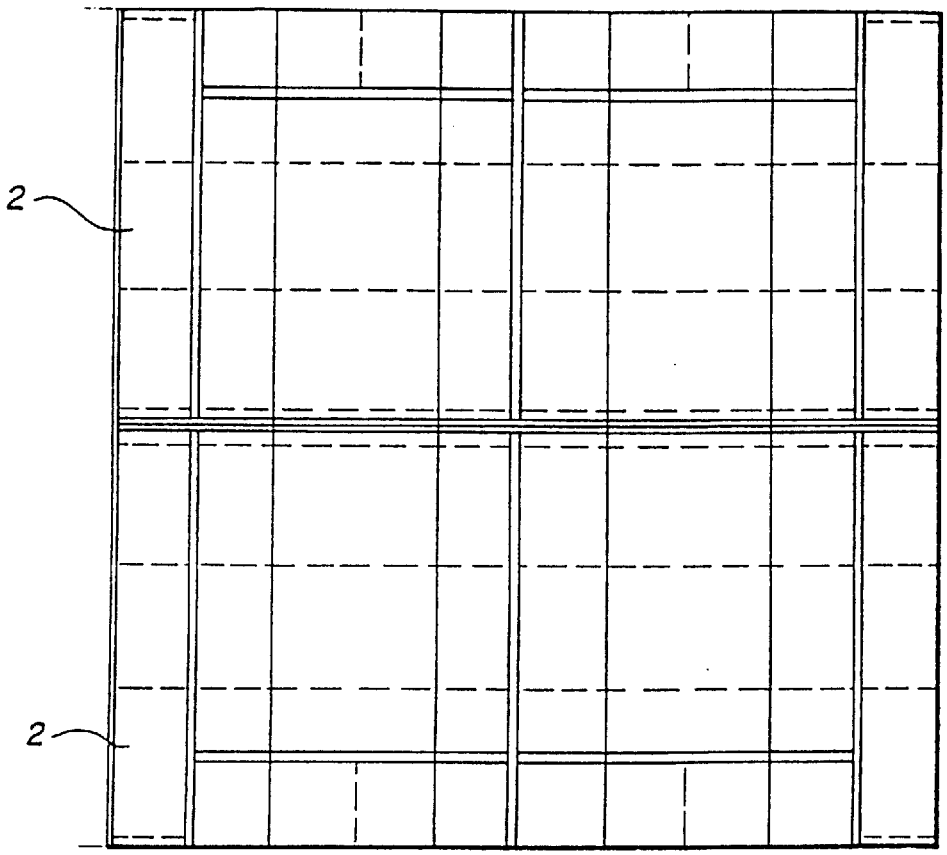
FIG. 14 is a top view of roofing panel placement.

Referring to FIG. 10C, adhered to the undersides of mitered rafters 50 are plate strips 58. The plate strips function as adhesion supports for rafter inserts 52, shown in FIG. 11, in cooperation with plate angles 48, plate angles 48 being adhered to the front and rear rafter assemblies. Rafters 50 are attached using adhesives at the overhang ends of the beams in face to face relationship as shown in FIG. 11. Fascia boards 6 are adhered to the beam ends 26 on the sidewall sections, then overhang inserts 54, shown in FIG. 13, are adhered to side fascia boards and to top-plates 28. Mitered fascia boards 8 in FIG. 13 are adhered to front and rear ends of roof pitch beam 44, and to the ends of sidewall fascia boards 6. Overhang inserts 54 are adhered into proper place as shown in FIG. 13, between the fascia boards and mitered rafters 50. Reference to FIG. 12 shows how soffit boards 56 are adhered to the fascia boards and overhang inserts 54 on the underside of the front and rear overhangs as shown in FIG. 12. Soffit boards 56 are adhered to the bottom overhang of the beams 26. Referring to FIG. 14, corrugated roof sheeting panels 2 made of suitable plastic composition, either clear or opaque, are adhered in pairs on either side of the roof ridge beginning at either the rear end or front end of the building. The corrugated roofing sheet panels are oriented upon the roof rafters and inserts so that corrugations run in the direction from the roof ridge to the eaves. The dotted lines in FIG. 14 show the placement of adhesive.

Wall boards 10 may be attached to studs and the external portions of the framing members, via the use of polymer adhesives, beginning at the top and working around the building's perimeter one row at a time until finished at the bottom. Trim is placed at the corners and attached using polymer adhesives in place of hardware, this provides for faster assembly, and requires the builder to assemble the building without the use of cumbersome tools and fastening parts. Guttering may be added, if desired, using gutter screws or toggle bolts. Remaining elements of the building may be installed in the manner substantially similar to that used to assemble the principal structural elements as herein described.

Although the invention described herein has been directed to static building structures, it is also contemplated that the methods disclosed herein may be used for fabricating structures other than static buildings. For example, movable vending carts or kiosks may be made by the methods taught herein. In the case of a vending kiosk on wheels, for example, a base plate may be comprised of suitable wooden or PVC core filled boards attached to a floor panel, with wheels mounted on the underside for easy movement. The methods of construction may be substantially similar to those used in building static structures. Wall posts may be adhered to lintels while they are in a horizontal position and then posts and lintels as a unit secured into position on a base plate using angle-clips. In place of siding boards, solid panels may be used to form walls. Such structures may be designed to serve different vending businesses, such as coffee, ice-cream, soft-drinks and snack foods, to name a few. Further, although angle-clips used for constructing the building disclosed herein have been described as being right-angled elements, it is contemplated that angle-clips other than those having a right angle configuration may be used. For example, were diagonally positioned bracing desired to be placed between vertical studs, for example, angle-clips greater than and less than 90 degrees would be required.

The expression "adhesive bonding" as used in the present disclosure means a bonding or joining of two surfaces wherein significant interaction takes place between the surfaces joined and a polymer adhesive, said interaction involving mechanical interlocking at the surfaces, surface tension properties of the plastic materials and the molecular diffusion and inter-penetration of surface materials and adhesive.

The expression "utility" in reference to use of the structures herein disclosed means article or device of a general nature which is useful to humans in the course of daily life.

The expression "integrated structural building" means a building enclosing a three dimensional space having at least four vertical side walls, roof framing and roof structure.

It is to be understood that the present invention is not limited to the embodiments described above, but encompasses any and all embodiments within the scope of the following claims.

What is claimed is:

1. A utility building or housing consisting essentially of a plurality of plastic structural elements comprising base plates, stud posts, top plates, roof beams and L-shaped angle clips, wherein the stud posts are fastened to the base plates, top plates and roof beams by means of the L-shaped angle clips and polymer adhesive between the clips and the structural elements.

2. The utility building or housing of claim 1 wherein said plastic is polyvinyl chloride.

3. The utility housing or building of claim 1 further comprising door and window framing members wherein the base plates and framing members are wood-core plastic-coated structural elements having a pressure treated wood core.

4. The utility building or housing of claim 1 further comprising plastic roof panels and plastic siding boards attached using polymer adhesive to the structural elements and plastic trim attached to the siding boards using a polymer adhesive.

5. A lightweight, static building or housing structure capable of housing, storing, and containing utility articles, said structure comprising:

a solid horizontal foundation with rectangularly cross-sectioned base plate members made of wooden-core synthetic polymer materials, the members being attached to the foundation by mechanical fastener means;

a plurality of vertical wall studs made of a hollow-core synthetic polymer materials having a first end and a second end and a plurality of right-angled, angle clips made of a synthetic polymer material, wherein said first ends of said studs are joined to said base plate members using said angle clips, said clips being attached to said base plate members and to said first ends of said studs using polymer adhesives so that said studs extend perpendicularly from said base plate members;

horizontal top plate members made of hollow-core, synthetic polymer materials and attached using a polymer adhesive to said angle clips which are attached to said wall studs at said second ends thereof by means of a polymer adhesive;

and a plurality of roofing elements comprising hollow-core roof rafters made of a synthetic polymer material, the rafters being attached to said top plate members using a polymer adhesive.

6. The building or housing structure of claim 3 wherein said synthetic polymer material is selected from the group consisting of polyvinyl chloride and copolymers of polyvinyl chloride with other vinyl monomers.

7. The building or housing structure of claim 4, wherein the polymer adhesives are comprised of adhesive compositions formulated to bond polyvinyl chloride materials to other polyvinyl chloride materials.

8. The building or housing structure of claim 5 further comprising a plurality of horizontal beams made of synthetic polymer materials, each of the horizontal beams being supported by at least two of said vertical wall studs, and each of said beams having an extension beyond the wall studs to provide a roof overhang, said studs and said beams being attached together at the second end of said studs using a polymer adhesive and right-angled, angle-clips made of a synthetic polymer material which clips provide strengthening and attachment means therebetween.

9. The building or housing structure of claim 5 further comprising a plurality of horizontal headers made of hollow-core synthetic polymer materials, said headers being joined to vertical wall studs at the second end of said studs thereof with the horizontal headers therebetween using a polymer adhesive and right-angled clips made of a synthetic polymer material to provide a T-shaped wall stud insert.

10. The building or housing structure of claim 5 wherein the wood-core synthetic polymer materials comprise a pressure treated wood core having a polyvinyl chloride covering.

11. The building or housing structure of claim 5 further comprising solid sheet roofing panels and soffit panels made of synthetic polymer materials which are attached to said top plates and rafters using a polymer adhesive to form a completed roof.

12. The building or housing structure of claim 11 further comprising plastic siding boards attached using polymer adhesive to the vertical wall studs and plastic trim attached to the siding boards using a polymer adhesive.

13. The building or housing structure of claim 5 further comprising plastic siding boards attached using polymer adhesive to the vertical wall studs and plastic trim attached to the siding boards using a polymer adhesive.

14. A method of constructing a building structure, said structure being comprised of joint fastening angle-clips and structural elements selected from the group consisting of posts, beams, sheathing, rafters, studs, trim, supporting elements, sills, headers, fascia boards, soffit boards, roof sheeting and wall boards, the composition of said angle-clips and said structural elements consisting essentially of synthetic polymer material, said method comprising the steps of:

(1) applying a polymer adhesive to a portion of a first structural element;

(2) applying a polymer adhesive to a portion of a second structural element to be joined to said first structural element using a joint-fastening angle clip to join the first structural element to the second structural element;

(3) applying a polymer adhesive to wall or roof panel elements to be joined to said fist structural elements or to roof structural elements;

(4) contacting and holding in place said first and second structural elements and said angle clip or said first or roof structural elements and said wall or roof panel elements for a time sufficient to allow adhesive bonding between said elements or between said elements and said angle clip, and (5) repeating steps 1–4 with a plurality of said structural elements, panels and angle clips for a plurality of times to form an integrated structural building wherein the all of the structural elements, panels and angle clips are joined together in the substantial absence of mechanical fastening devices.

15. The method of claim 14 wherein said synthetic polymer material is selected from the group consisting of polyvinyl chloride and copolymers of polyvinyl chloride with other vinyl monomers.

16. The method of claim 15 wherein said polymer adhesive is comprised of adhesive compositions formulated to bond polyvinyl chloride materials to other polyvinyl chloride materials.

* * * * *

UNITED STATES PATENT AND TRADEMARK OFFICE

CERTIFICATE OF CORRECTION

PATENT NO. : 5,826,389

DATED : Oct. 27,1 998

INVENTOR(S) : Steven Lynn Siler

It is certified that error appears in the above-identified patent and that said Letters Patent is hereby corrected as shown below:

Column 5, line 16, change "comers" to --corners--;

Column 9, line 14, change "claim 3" to --claim 5--;

Column 9, line 18, change "claim 4" to --claim 6--;

Column 10, line 25, change "fist" to --first--.

Signed and Sealed this

Twenty-third Day of February, 1999

*Attest:*

Q. TODD DICKINSON

*Attesting Officer*

*Acting Commissioner of Patents and Trademarks*